United States Patent [19]

Villafañe

[11] 4,313,229

[45] Feb. 2, 1982

[54] DISPOSABLE RAINWEAR

[76] Inventor: Aida L. Villafañe, 1920 Sauco St., Santa Maria Rio Piedras, P.R. 00927

[21] Appl. No.: 119,050

[22] Filed: Feb. 6, 1980

[51] Int. Cl.[3] ..... A41D 3/04; A41D 3/06

[52] U.S. Cl. ..... 2/84; 2/87; 2/82

[58] Field of Search ..... 2/84, 88, 87, 86

[56] References Cited

U.S. PATENT DOCUMENTS 2,911,651 11/1959 Nye et al. ..... 2/84

3,111,677 11/1963 Artzt ..... 2/84

*Primary Examiner*—Doris L. Troutman

*Attorney, Agent, or Firm*—Scrivener, Clarke, Scrivener and Johnson

[57] ABSTRACT

The disclosure is of a raincoat, hood and leggings which are particularly constructed and related for separate or combined dispensing from a coin-operated machine or over the counter.

3 Claims, 9 Drawing Figures

DISPOSABLE RAINWEAR

SUMMARY OF THE INVENTION

The invention provides a raincoat, a hood and leggings, each of which may optionally be dispensed separately or in any desired combination, in continuous strip form for dispensation from a coin-operated machine or in packet form for dispensation from a coin-operated machine or over the counter.

DESCRIPTION OF THE INVENTION

Figure 1:
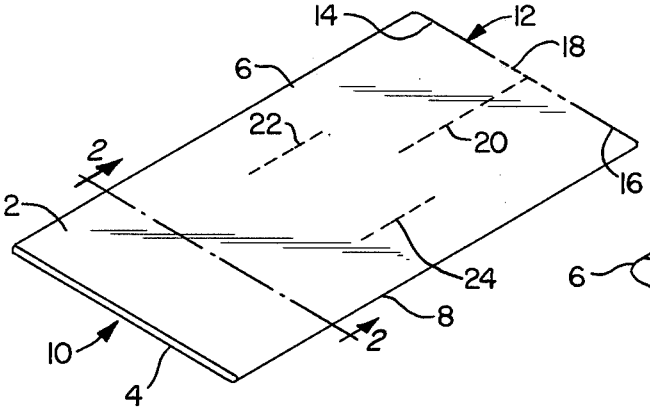
FIG. 1 is a perspective view of a raincoat according to the invention.
Figure 2:
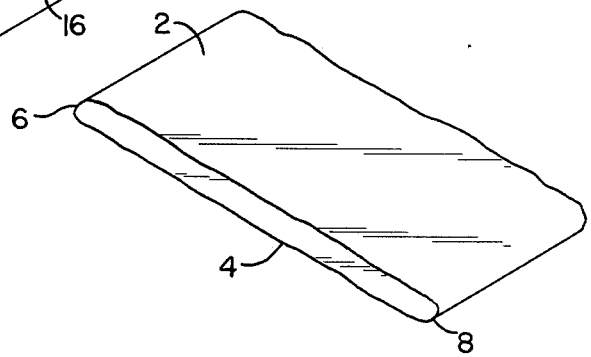
FIG. 2 is a cross-sectional view taken on line 2—2 of FIG. 1.

The preferred embodiment of the raincoat provided by the invention is disclosed in FIGS. 1 and 2 and comprises two rectangular sheets of waterproofed plastic fabric 2, 4 which are of the same size and shape and which are normally positioned in superposed surface-to-surface relation with their side edges 6, 8 in registry and connected in any suitable manner as by sealing, and with their end edges 10, 12 in registry. At its one end 10 the sheets are un-connected and at its other end 12 the end edges are joined along lines 14, 16 adjacent to the side edges and between these lines the sheets are separably connected along a tear line 18. A second tear line 20 extends at right angles to the end edge 12 at the center of tear line 18, and two parallel tear lines 22, 24 are positioned adjacent to the side edges 6, 8 and are parallel thereto and to the tear line 20 and are spaced from end edge 12 in the direction of end edge 10.

The body of the raincoat forms a sheath which may be slipped over the head from open end 10, the head of the wearer being put through the aperture formed by opening the tear lines 18, 20 and the arms being put through the openings formed by tear lines 22, 24.

Figure 3:
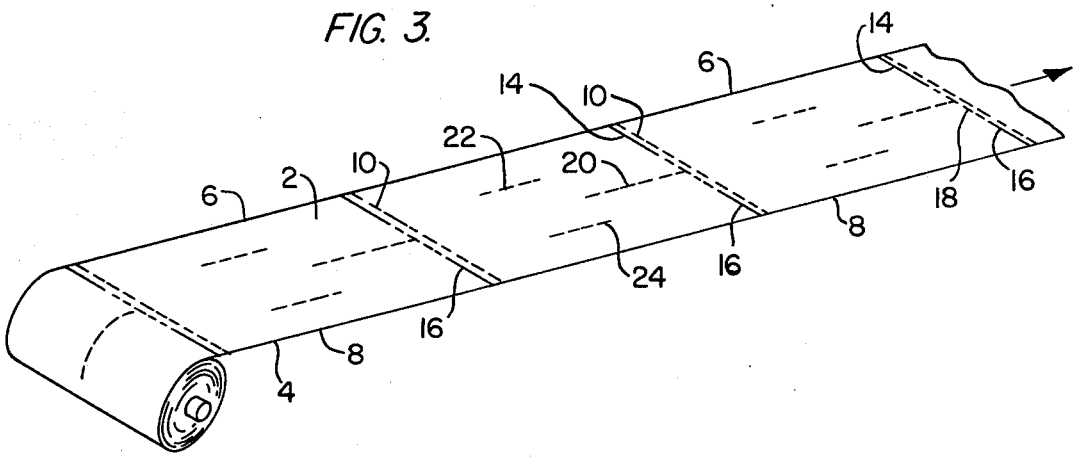
FIG. 3 is a perspective view of a plurality of the raincoats of FIGS. 1 and 2 separably connected end-to-end in a continuous strip and rolled.

The raincoat may be dispensed in packet form from a coin-operated vending machine or over the counter, and in further accordance with the invention, and as disclosed in FIG. 3, the raincoats may be formed in a continuous strip which may be rolled for dispensing from a machine. In this strip each of the end edges 10 of the two sheets of the raincoat at the open end of the raincoat are formed as tear lines so that each raincoat may be separated from the strip.

Figure 4:
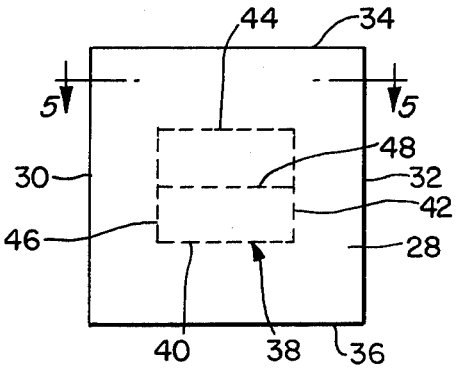
FIG. 4 is an elevational view of a hood according to the invention.
Figure 5:
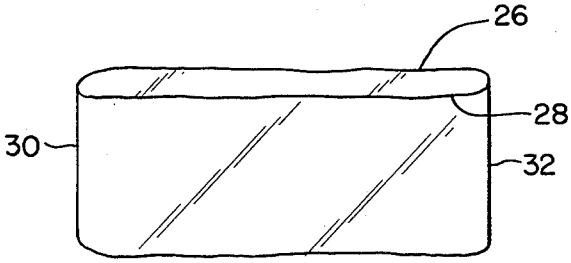
FIG. 5 is a perspective view taken on line 5—5 of FIG. 4.

In further accordance with the invention a head covering or hood is provided, and is constructed for separate dispensing, either in the form of a packet sold over the counter or in rolled or packet form to be dispensed from a coin-operated machine, and either separately or in combination with the raincoat. As disclosed in FIGS. 4 and 5 each hood comprises two rectangular sheets 26,28, of waterproofed clear plastic fabric material which are arranged in superposed surface-to-surface relation and connected along their registering side edges 30, 32 and their one end edge 34, leaving the other end edge 36 un-connected so that the hood is open at that end and may be drawn over the wearer's head. One of the sheets, which is sheet 28 in the illustrated embodiment, is provided with a centrally located preferably rectangular area 38 which is defined by tear lines 40, 42, 44, 46 and is divided transversely by a tear line 48 which is parallel to the end edges 34, 36 of the hood and extends entirely across the area 38. The wearer may, if desired, remove the entire area 38 to facilitate sight or may separate the upper and lower parts of the area by opening tear line 48 to facilitate breathing. If the two sheets 26, 28 constituting the hood are formed of opaque material the area 38 is preferably formed of transparent material.

Figure 6:
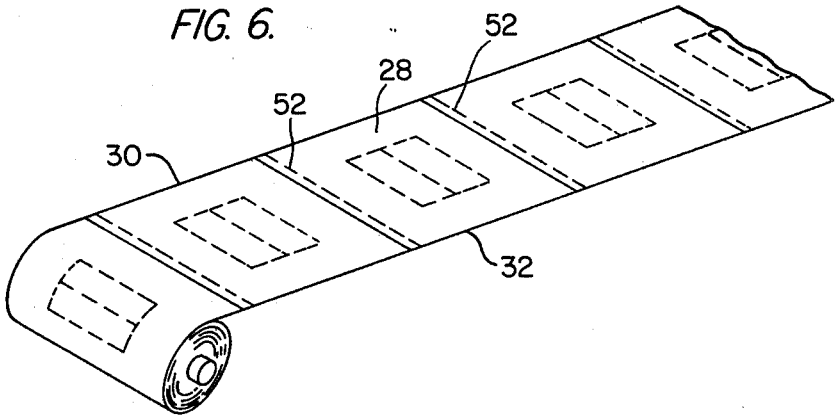
FIG. 6 is a perspective of a plurality of the hoods of FIGS. 4 and 5 separably connected end-to-end in a continuous strip and rolled.

In still further accordance with the invention a plurality of the hoods are separably connected in a continuous strip which may be rolled for dispensation from a coin-operated machine, such a continuous strip being illustrated in FIG. 6. In such a continuous strip adjacent hoods are separably connected by tear lines 52 which extend across the continuous strip and, after being torn, form the open end edges 36 of the hood.

Figure 7:
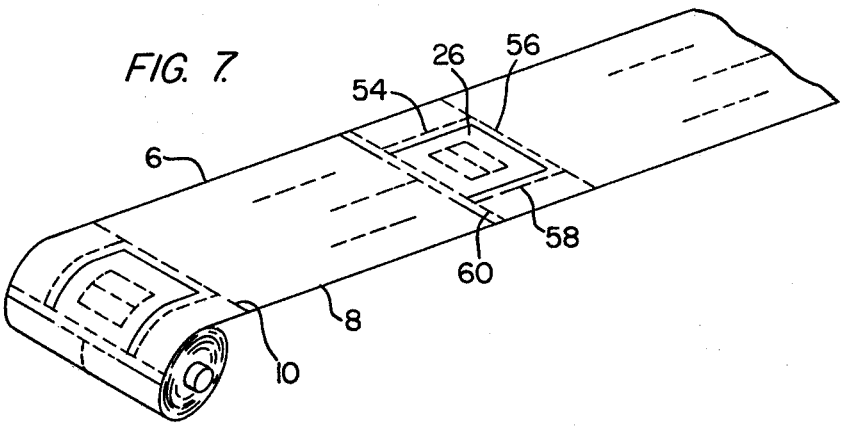
FIG. 7 is an elevational view of a continuous strip of raincoats and hoods separably connected in a continuous strip in alternate relation and rolled.

A plurality of raincoats and hoods may be alternately and separably connected in a continuous strip for dispensing from a coin-operated machine, and such a strip is disclosed in FIG. 7. Because the hood is smaller than the raincoat, sheets 26, 28 are extended to meet side edges 6, 8 of the raincoat strip. The hood, centrally located, is separated by tear lines 54, 56, 58, 60. In this strip, the end edges 10 of each raincoat, at the open end of the raincoat, are formed as tear lines 56 and the end edges 36 of each hood, at the open end of the hood, are formed as tear lines 60.

Figure 8:
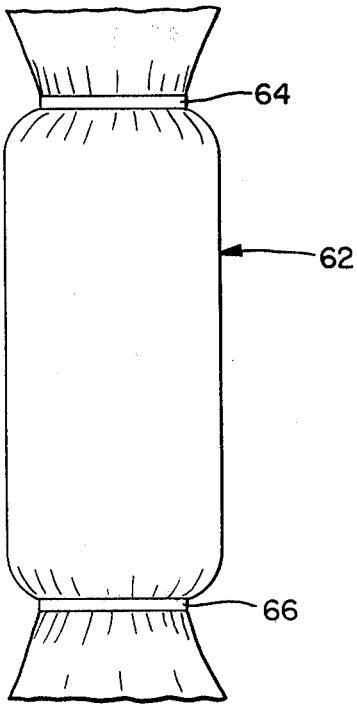
FIG. 8 is an elevational view of a legging provided by the invention.
Figure 9:
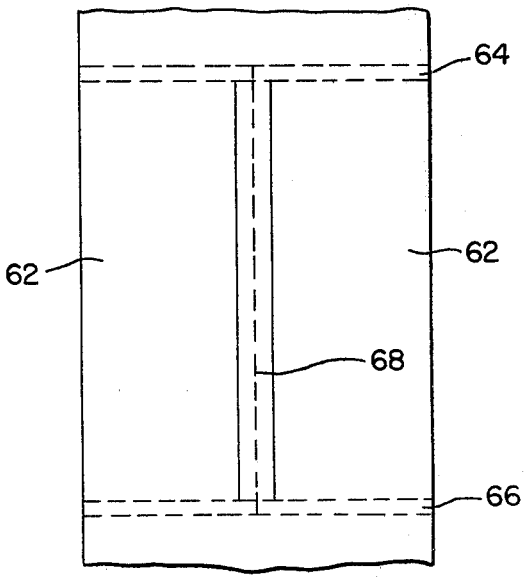
FIG. 9 is an elevational view of a plurality of leggings connected in a continuous strip of separably connected leggings.

The invention also provides means for protecting the legs, and such means comprise two flat strips of waterproof material, each of which is constructed and adapted to be wrapped about one of the legs of the wearer, to provide two leggings, and means for holding the leggings in place. One legging is illustrated at 62 in FIG. 8 in position surrounding the leg of a wearer and tied in place by two strips 64, 66 formed of waterproof material which may, for example, be below the knee and above the ankle, respectively. The leggings and tying strips may be formed into a continuous strip for dispensing, and such an assembly is disclosed in FIG. 9 and comprises a continuous strip in which two leggings 62 are positioned in side-by-side relation extending length-wise of the strip. The two tie strips 64, 66 extend transversely of the strip at the opposite ends of the two leggings, respectively. The longitudinal side edges of the tie strips are defined by tear lines, and another tear line 68 extends midway between the leggings 62 from one tie strip to the other.

It will be understood that each of the three items of rainwear described herein may be made and dispensed in various sizes such, for example, as petite, small, medium, large and extra large, and in various colors and weights.

I claim:

1. A disposable and dispensable article of rainwear for the human body, comprising two sheets of waterproof fabric arranged in surface-to-surface relation with their side edges connected to form a sheath, a. the sheath having an open end edge, and a second end edge which is normally closed, b. the second end edge of the sheath having at its central part a normally closed tear line, c. one of the sheets having therein a normally closed tear line extending perpendicularly from the center of the central tear line toward the open end edge to provide with the central tear line a normally closed but openable T-shaped passage for the head of the wearer, and d. said one of the sheets having therein two normally closed tear lines which are parallel to each other and are positioned respectively adjacent the side edges and are spaced from the second end edge and are so positioned and of sufficient length to permit passage of the arms of the wearer.

2. An article of rainwear according to claim 1, comprising in addition a hood forming member comprising two superposed sheets connected by normally closed tear lines to the two sheets of the raincoat, the hood sheets being rectangular in shape and one of the hood sheets having a centrally located area defined by rectangularly positioned normally closed tear lines.

3. An article of rainwear according to claim 1, comprising in addition two tubular legging forming members positioned side by side and connected by means including a normally closed tear line, and a tie strip extending transversely of the two legging forming members at each end of the two members, the longitudinal edges of each tie strip being defined by normally closed tear lines.

* * * * *